US010112103B2

(12) United States Patent
Kloster et al.

(10) Patent No.: US 10,112,103 B2
(45) Date of Patent: Oct. 30, 2018

(54) SPLITBOARD JOINING DEVICE

(71) Applicants: Bryce M. Kloster, Seattle, WA (US); Tyler G. Kloster, Snoqualmie, WA (US)

(72) Inventors: Bryce M. Kloster, Seattle, WA (US); Tyler G. Kloster, Snoqualmie, WA (US)

( * ) Notice: Subject to any disclaimer, the term of this patent is extended or adjusted under 35 U.S.C. 154(b) by 0 days.

(21) Appl. No.: 15/790,527

(22) Filed: Oct. 23, 2017

(65) Prior Publication Data

US 2018/0140930 A1 May 24, 2018

Related U.S. Application Data

(63) Continuation of application No. 15/470,142, filed on Mar. 27, 2017, now Pat. No. 9,795,861, which is a continuation of application No. 15/139,175, filed on Apr. 26, 2016, now Pat. No. 9,604,122.

(60) Provisional application No. 62/153,366, filed on Apr. 27, 2015.

(51) Int. Cl.

| | |
|---|---|
| ***A63C 5/16*** | (2006.01) |
| ***A63C 5/03*** | (2006.01) |
| ***A63C 5/06*** | (2006.01) |
| ***A63C 5/02*** | (2006.01) |

(52) U.S. Cl.

CPC ..... *A63C 5/031* (2013.01); *A63C 5/02* (2013.01); *A63C 5/06* (2013.01); *A63C 2203/06* (2013.01)

(58) Field of Classification Search

CPC ..... A63C 5/16; A63C 5/031

USPC ..... 280/603, 818

See application file for complete search history.

(56) References Cited

U.S. PATENT DOCUMENTS

| | | | | |
|---|---|---|---|---|
| 31,259 A | | 1/1861 | Rich | |
| 1,473,011 A | | 11/1923 | Christophel | |
| 1,477,692 A | | 12/1923 | Christophel | |
| 2,660,812 A | | 12/1953 | Henke | |
| 3,061,325 A | | 10/1962 | Glass | |
| 3,171,667 A | * | 3/1965 | Wightman | A63C 5/16 280/818 |

(Continued)

FOREIGN PATENT DOCUMENTS

| | | |
|---|---|---|
| CH | 681 509 A5 | 4/1993 |
| DE | 89 03154 | 3/1989 |

(Continued)

OTHER PUBLICATIONS

Brochure for Nitro USA Snowboards, dated 1993-1994.

(Continued)

*Primary Examiner* — Jeffrey J Restifo

(74) *Attorney, Agent, or Firm* — Knobbe, Martens, Olson & Bear, LLP

(57) ABSTRACT

Some embodiments disclosed herein provide an apparatus for joining two skis to form a splitboard. The apparatus can comprise a first attachment portion configured to attach to a first ski and a second attachment portion configured to attach to a second ski. The first attachment portion and the second attachment portion can be configured to engage to prevent splitboard skis from moving up and down relative to each other, from moving apart in a direction perpendicular to a seam of the splitboard, from sliding relative to each other in a direction parallel to the seam, and from rotating about the seam of the splitboard.

23 Claims, 7 Drawing Sheets

(56) References Cited

U.S. PATENT DOCUMENTS 3,439,928 A 4/1969 Noguchi
3,506,279 A 4/1970 Lambert
3,593,356 A 7/1971 Schmalfeldt
3,627,349 A 12/1971 Barry
3,677,566 A 7/1972 Lawrence
3,782,745 A 1/1974 Stoveken
3,861,698 A 1/1975 Greig
4,022,491 A 5/1977 Powell
4,062,553 A 12/1977 Riedel
4,085,528 A 4/1978 Delery
4,138,128 A 2/1979 Criss
4,163,565 A 8/1979 Weber
4,190,970 A 3/1980 Annovi
4,221,394 A 9/1980 Campbell
4,275,904 A * 6/1981 Pedersen ..... A63C 5/16 280/14.1
4,403,785 A 9/1983 Hottel
4,428,608 A 1/1984 Cooke et al.
4,473,235 A 9/1984 Burt
4,547,981 A 10/1985 Thais et al.
4,652,007 A 3/1987 Dennis
4,700,967 A 10/1987 Meatto et al.
4,705,308 A 11/1987 Bisbing
4,728,116 A 3/1988 Hill
4,741,550 A 5/1988 Dennis
4,770,441 A 9/1988 Demonsant et al.
4,817,988 A 4/1989 Chauvet et al.
4,856,808 A 8/1989 Longoni
4,871,337 A 10/1989 Harris
4,949,479 A 8/1990 Ottieri
4,951,960 A 8/1990 Sadler
4,955,632 A 9/1990 Giarritta et al.
4,973,073 A 11/1990 Raines et al.
4,979,760 A 12/1990 Derrah
4,982,733 A 1/1991 Broadhurst et al.
5,028,068 A 7/1991 Donovan
5,035,443 A 7/1991 Kincheloe
5,044,654 A 9/1991 Meyer
5,065,530 A 11/1991 Pozzobon et al.
5,065,533 A 11/1991 Paris
5,069,463 A 12/1991 Baud et al.
5,109,616 A 5/1992 Lush
5,145,202 A 9/1992 Miller
5,156,644 A 10/1992 Koehler et al.
5,249,816 A 10/1993 Southworth
5,299,823 A 4/1994 Glaser
5,344,179 A 9/1994 Fritschi et al.
5,397,150 A 3/1995 Commier et al.
5,462,318 A 10/1995 Cooke
5,499,461 A 3/1996 Danezin et al.
5,542,197 A 8/1996 Vincent
5,551,728 A * 9/1996 Barthel ..... A63C 5/02 280/14.1
5,553,883 A 9/1996 Erb
5,558,354 A 9/1996 Lion
5,570,522 A 11/1996 Olson et al.
5,618,051 A 4/1997 Kobylenski et al.
5,649,722 A * 7/1997 Champlin ..... A63C 5/02 280/14.22
5,660,416 A * 8/1997 Schiele ..... A63C 5/031 280/14.21
5,697,631 A 12/1997 Ratzek et al.
5,701,689 A 12/1997 Hansen et al.
5,713,587 A 2/1998 Morrow et al.
5,741,023 A 4/1998 Schiele et al.
5,762,358 A 6/1998 Hale
5,765,853 A 6/1998 Erb
5,771,609 A 6/1998 Messmer
5,815,952 A 10/1998 Bobrowicz
5,816,590 A 10/1998 Fey et al.
5,820,139 A 10/1998 Grindl
5,884,933 A 3/1999 Trott
5,887,886 A 3/1999 Bourdeau
5,894,684 A 4/1999 Sand et al.
5,901,469 A 5/1999 Saillet
5,906,388 A 5/1999 Neiley
5,909,886 A 6/1999 Tugutaka et al.
5,937,546 A 8/1999 Messmer
5,941,552 A 8/1999 Beran
5,947,487 A 9/1999 Keleny et al.
5,966,843 A 10/1999 Sand et al.
5,966,844 A 10/1999 Hellerman et al.
5,979,082 A 11/1999 Pallatin
5,984,324 A * 11/1999 Wariakois ..... A63C 5/02 280/14.24
5,984,325 A 11/1999 Acuna
6,000,711 A * 12/1999 Fey ..... A63C 5/02 280/14.21
6,015,161 A 1/2000 Carlson
6,041,721 A 3/2000 Weston
6,082,026 A 7/2000 Sand et al.
6,089,592 A 7/2000 Negus
6,105,992 A 8/2000 Schaller et al.
6,116,634 A 9/2000 Mometti
6,126,625 A 10/2000 Lundberg
6,138,384 A 10/2000 Messmer
6,206,402 B1 3/2001 Tanaka
6,231,057 B1 5/2001 Reuss et al.
6,272,772 B1 8/2001 Sherman
6,276,708 B1 8/2001 Hogstedt
6,390,492 B1 5/2002 Bumgarner et al.
6,464,237 B1 10/2002 Gracie
6,505,841 B1 1/2003 Kessler et al.
6,523,851 B1 * 2/2003 Maravetz ..... A63C 5/02 280/14.22
6,554,295 B2 4/2003 Rittmeyer
6,578,865 B1 6/2003 Chaput
6,609,720 B2 8/2003 Marmonier
6,616,151 B1 9/2003 Golling
6,648,365 B1 11/2003 Laughlin et al.
6,705,633 B2 3/2004 Poscich
6,729,642 B2 5/2004 Gouzes et al.
6,733,030 B2 5/2004 Okajima et al.
6,786,502 B2 9/2004 Carlson
6,792,702 B2 9/2004 Borsoi et al.
6,863,285 B2 3/2005 Gonthier
6,969,075 B2 11/2005 Dean et al.
7,029,023 B2 4/2006 Fourgere
7,073,813 B2 7/2006 Martin et al.
7,097,194 B2 8/2006 Kogler
7,147,233 B2 12/2006 Edmond
7,204,495 B2 4/2007 Reuss et al.
7,207,592 B2 4/2007 Pascal et al.
7,232,147 B2 6/2007 Courderc
7,246,811 B2 7/2007 Martin et al.
7,267,357 B2 9/2007 Miller et al.
7,306,241 B2 12/2007 Cunningham et al.
7,320,474 B2 1/2008 Quellais et al.
7,367,579 B2 5/2008 Elkington
7,427,079 B2 9/2008 Piva
7,503,579 B2 3/2009 Courderc
7,516,976 B2 4/2009 Cunningham et al.
7,568,719 B2 8/2009 Sauter
7,621,542 B2 11/2009 Warburton et al.
7,628,419 B2 * 12/2009 Gogarty ..... A63C 5/0428 280/600
7,669,880 B2 3/2010 Doyle et al.
7,681,904 B2 3/2010 Ekberg
7,694,994 B2 4/2010 Lang et al.
7,823,905 B2 11/2010 Ritter
7,832,754 B2 11/2010 Girard et al.
7,931,292 B2 4/2011 Miralles
7,992,888 B2 8/2011 Steere
8,033,564 B2 * 10/2011 Riepler ..... A63C 5/02 280/603
8,132,818 B2 3/2012 Cunningham et al.
8,167,321 B2 5/2012 Cunningham et al.
8,226,109 B2 * 7/2012 Ritter ..... A63C 5/02 280/14.26
8,348,299 B2 1/2013 Ekberg
8,371,605 B2 2/2013 Neiley et al.
8,469,372 B2 * 6/2013 Kloster ..... A63C 5/02 280/14.22
8,480,546 B2 7/2013 Spencer

(56) References Cited

U.S. PATENT DOCUMENTS

| | | | | |
|---|---|---|---|---|
| 8,662,505 | B2 | 3/2014 | Cunningham et al. | |
| 8,684,394 | B2 | 4/2014 | Smith | |
| 8,708,371 | B2 * | 4/2014 | Balun | A63C 5/033 280/14.21 |
| 8,720,910 | B2 | 5/2014 | Caslowitz | |
| 8,733,783 | B2 | 5/2014 | Kloster et al. | |
| 8,764,043 | B2 * | 7/2014 | Neubauer | A63C 10/16 280/607 |
| 8,857,845 | B2 | 10/2014 | Ohlheiser | |
| 9,132,336 | B2 * | 9/2015 | Bulan | A63C 5/02 |
| 9,138,628 | B2 | 9/2015 | Kloster et al. | |
| 9,220,968 | B2 | 12/2015 | Ritter | |
| 9,227,131 | B2 * | 1/2016 | Adamczewski | A63C 5/033 |
| 9,238,168 | B2 * | 1/2016 | Kloster | A63C 5/02 |
| 9,266,010 | B2 | 2/2016 | Kloster et al. | |
| 9,452,344 | B2 | 9/2016 | Ritter | |
| 9,604,122 | B2 * | 3/2017 | Kloster | A63C 5/031 |
| 9,795,861 | B1 | 10/2017 | Kloster et al. | |
| 9,937,407 | B2 | 4/2018 | Kloster et al. | |
| 2002/0062581 | A1 | 5/2002 | Courderc | |
| 2003/0075885 | A1 | 4/2003 | Laughlin | |
| 2004/0061311 | A1 | 4/2004 | De Bortoli et al. | |
| 2004/0169343 | A1 | 9/2004 | Fougere | |
| 2005/0057009 | A1 | 3/2005 | Courderc | |
| 2005/0161911 | A1 | 7/2005 | Piva | |
| 2005/0177083 | A1 | 8/2005 | Heil | |
| 2005/0253347 | A1 | 11/2005 | Martin et al. | |
| 2006/0175802 | A1 | 8/2006 | Maravetz et al. | |
| 2006/0237920 | A1 | 10/2006 | Steere | |
| 2007/0063459 | A1 | 3/2007 | Kavarsky | |
| 2007/0170697 | A1 | 7/2007 | Courderc | |
| 2007/0216137 | A1 | 9/2007 | Ritter | |
| 2008/0116664 | A1 | 5/2008 | Warburton | |
| 2008/0185814 | A1 * | 8/2008 | Riepler | A63C 5/02 280/601 |
| 2009/0146396 | A1 | 6/2009 | Hahnenberger | |
| 2009/0146397 | A1 | 6/2009 | Steere | |
| 2009/0250906 | A1 | 10/2009 | Ritter | |
| 2010/0102522 | A1 * | 4/2010 | Kloster | A63C 5/02 280/14.24 |
| 2010/0304937 | A1 | 12/2010 | Spencer | |
| 2011/0184326 | A1 | 7/2011 | Ingimundarson et al. | |
| 2011/0197362 | A1 | 8/2011 | Chella et al. | |
| 2011/0254251 | A1 | 10/2011 | Jung | |
| 2011/0285109 | A1 | 11/2011 | Horn | |
| 2012/0061927 | A1 | 3/2012 | Krenn | |
| 2012/0256395 | A1 * | 10/2012 | Ritter | A63C 5/02 280/623 |
| 2012/0274036 | A1 * | 11/2012 | Kloster | A63C 5/0411 280/11.31 |
| 2012/0292887 | A1 | 11/2012 | Ohlheiser | |
| 2013/0147159 | A1 | 6/2013 | Neiley et al. | |
| 2013/0193672 | A1 * | 8/2013 | Bulan | A63C 5/033 280/607 |
| 2013/0214512 | A1 * | 8/2013 | Kloster | A63C 5/02 280/609 |
| 2013/0341889 | A1 | 12/2013 | Neubauer | |
| 2014/0210187 | A1 | 7/2014 | Ritter | |
| 2014/0232087 | A1 * | 8/2014 | Bulan | A63C 5/02 280/620 |
| 2015/0014962 | A1 * | 1/2015 | Rayner | A63C 10/145 280/611 |
| 2015/0021881 | A1 | 1/2015 | Hutchison | |
| 2015/0048597 | A1 | 2/2015 | Tudor | |
| 2015/0157920 | A1 * | 6/2015 | Adamczewski | A63C 5/033 280/601 |
| 2015/0343297 | A1 | 12/2015 | Ekberg | |
| 2016/0136505 | A1 | 5/2016 | Kavarsky | |
| 2016/0175691 | A1 | 6/2016 | Ritter | |
| 2016/0199722 | A1 | 7/2016 | Ritter | |
| 2016/0279505 | A2 | 9/2016 | Ritter | |
| 2016/0310824 | A1 * | 10/2016 | Kloster | A63C 5/031 |
| 2016/0310825 | A1 | 10/2016 | Kloster et al. | |
| 2017/0050105 | A1 * | 2/2017 | Browning | A63C 5/02 |
| 2017/0189788 | A1 | 7/2017 | Wariakois | |
| 2017/0216710 | A1 | 8/2017 | Debney | |
| 2017/0282050 | A1 * | 10/2017 | Kloster | A63C 5/031 |

FOREIGN PATENT DOCUMENTS

| | | |
|---|---|---|
| DE | 91 08 618 | 1/1992 |
| DE | 296 18 514 U1 | 10/1996 |
| EP | 0 362 782 A2 | 4/1990 |
| EP | 0 680 775 B1 | 11/1995 |
| WO | WO 1998/017355 | 4/1998 |

OTHER PUBLICATIONS

U.S. Appl. No. 12/604,256, filed Oct. 22, 2009, including its prosecution history.

Web page showing Salomon SNS Pilot Combi binding, www.salomon.com/us/products/sns-pilot-combi.html, dated Mar. 20, 2012.

U.S. Appl. No. 13/458,560, filed Apr. 27, 2012, including its prosecution history.

U.S. Appl. No. 13/763,453, filed Feb. 8, 2013, including its prosecution history.

U.S. Appl. No. 13/915,370, filed Jun. 11, 2013, including its prosecution history.

U.S. Appl. No. 13/925,546, filed Jun. 24, 2013, including its prosecution history.

U.S. Appl. No. 14/287,938, filed May 27, 2014, including its prosecution history.

U.S. Appl. No. 14/860,213, filed Sep. 21, 2015, including its prosecution history.

U.S. Appl. No. 15/050,064, filed Feb. 22, 2016, including its prosecution history.

U.S. Appl. No. 15/139,175, filed Apr. 26, 2016, including its prosecution history.

U.S. Appl. No. 15/470,142, filed Mar. 27, 2017, including its prosecution history.

U.S. Appl. No. 15/790,927, filed Oct. 23, 2017, including its prosecution history.

U.S. Appl. No. 15/942,142, filed Mar. 30, 2018, including its prosecution history.

Purported excerpts of Nitro USA Snowboards Catalog, 1993-1994.

Purported brochure of Nitro USA Snowboards and Fritschi Tour Snowboard Binding.

Purported photographs of Nitro Board and Tour Lock System.

* cited by examiner

SPLITBOARD JOINING DEVICE

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57.

BACKGROUND

The present disclosure generally relates to split snowboards, also known as splitboards, and includes the disclosure of embodiments of splitboard joining devices. Splitboards are used for accessing backcountry terrain. Splitboards have a "ride mode" and a "tour mode." In ride mode, the splitboard is configured with at least two skis held together to form a board similar to a snowboard with bindings mounted somewhat perpendicular to the edges of the splitboard. In ride mode, a user can ride the splitboard down a mountain or other decline, similar to a snowboard. In tour mode, the at least two skis of the splitboard are separated and configured with bindings that are typically mounted like a cross country free heel ski binding. In tour mode, a user normally attaches skins to create traction when climbing up a hill. In some instances, additional traction beyond what the skins provide is desirable and, for example, crampons are used. When a user reaches the top of the hill or desired location the user can change the splitboard from tour mode to ride mode and snowboard down the hill.

SUMMARY

Some embodiments provide a splitboard joining device for combining the at least first ski and at least second ski of a splitboard into a snowboard, the splitboard having a seam where the at least first ski and at least second ski touch. The splitboard joining device can comprise a first attachment configured to attach to the at least first ski and a second attachment configured to attach to the at least second ski. The splitboard joining device can also comprise a first configuration where the first attachment and the second attachment are joined creating tension between the first attachment and the second attachment and compression between the first ski and the second ski, and a second configuration where the first attachment and the second attachment are disengaged in a direction generally perpendicular to the seam of the splitboard such that the first ski and second ski are configured to be separated. The first attachment can comprise at least one shear tab to extend over the second ski to prevent upward movement of the second ski relative to the first ski. The second attachment can comprise at least one shear tab to extend over the first ski to prevent upward movement of the first ski relative to the second ski, such that the at least one shear tab of the first attachment is configured to be moved between a first position and a second position. When the at least one shear tab of the first attachment is in the first position and engaged with the second attachment it can be configured to define the first configuration. When the at least one shear tab of the first attachment is in the second position and engaged with the second attachment it can be configured to define the second configuration.

Some embodiments provide an apparatus for joining two skis to form a splitboard. The apparatus can comprise a first attachment portion configured to attach to a first ski and a second attachment portion configured to attach to a second ski. The first attachment portion and the second attachment portion can be configured to engage to prevent splitboard skis from (1) moving up and down relative to each other; (2) moving apart in a direction perpendicular to a seam of the splitboard; (3) sliding relative to each other in a direction parallel to the seam; and (4) rotating about the seam.

BRIEF DESCRIPTION OF THE DRAWINGS

These and other features, aspects, and advantages of the disclosed apparatus, systems, and methods will now be described in connection with embodiments shown in the accompanying drawings, which are schematic and not necessarily to scale. The illustrated embodiments are merely examples and are not intended to limit the apparatus, systems, and methods. The drawings include the following figures, which can be briefly described as follows.

DESCRIPTION

Figure 1:
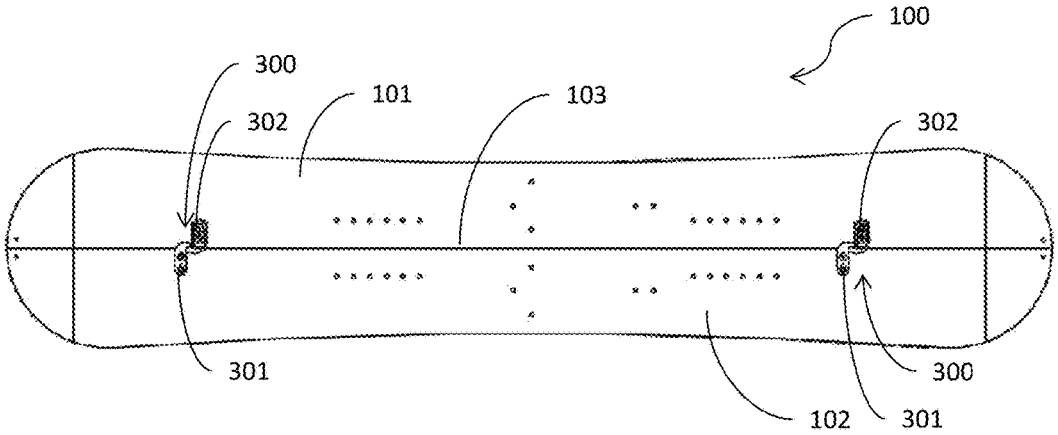
FIG. 1 is a top view of a splitboard in the snowboard configuration.

A splitboard is a snowboard that splits into at least two skis for climbing uphill in a touring configuration. When the splitboard is in the touring configuration, traction skins can be applied to the base of the snowboard to provide traction when climbing uphill. The user can use the skis like cross country skis to climb. When the user reaches a location where the user would like to snowboard down a hill, the user removes the traction skins and joins the at least two skis with a joining device to create a snowboard. An integral part of achieving optimal performance, such that the splitboard performs like a solid snowboard, is the joining device's ability to prevent the at least two skis from moving relative to each other.

Where the skis touch to create a snowboard is referred to as the "seam." If a splitboard has relative movement between the at least two skis, torsional stiffness is lost, flex in the splitboard is compromised, and ultimately performance is reduced which leads to lack of control for the user. For a splitboard to perform like a solid snowboard the joining device should allow the at least two skis to act as one snowboard with, for example, torsional stiffness and tip-to-tail flex. The joining device also should prevent the splitboard skis from shearing or moving up and down relative to each other, moving apart in a direction perpendicular to the seam, sliding relative to each other in a direction parallel to the seam, and rotating about the seam. Existing devices do not provide sufficient constraint in all four directions, or do not provide constraint in all four directions.

In order to fully constrain movement in the skis relative to each other in directions perpendicular and parallel to the seam, the joining device should create tension in itself and thus compression at the seam of the splitboard between the at least two skis. For this tension and compression to be obtained and still be able to easily separate the at least two skis, the joining device should have the ability to increase and decrease tension easily.

Some existing devices lack, among other things, the ability to fully constrain rotation about the seam of the splitboard. Fully constraining rotation about the seam of the splitboard is an important element to making a splitboard ride like a normal snowboard. If the splitboard can rotate about the seam, the rider's input into the splitboard is delayed creating a less responsive ride down the mountain. Some devices rely heavily on the precision of installation to attempt to limit rotation about the seam of the splitboard. As a result, if the device is installed loosely, or when the device wears down with use, rotation about the seam of the splitboard can occur, the skis can move perpendicularly to the seam of the splitboard, and the skis can move parallel to the seam of the splitboard, thereby creating a less responsive ride down the mountain. Such devices also lack the ability to create tension in the joining device and compression in the seam of the splitboard.

There is a need for a splitboard joining device that can quickly and easily join the skis of a splitboard to create a snowboard while preventing the splitboard skis from shearing or moving up and down relative to each other, moving apart in a direction perpendicular to the seam, sliding relative to each other in a direction parallel to the seam, and rotating about the seam.

Figure 2:
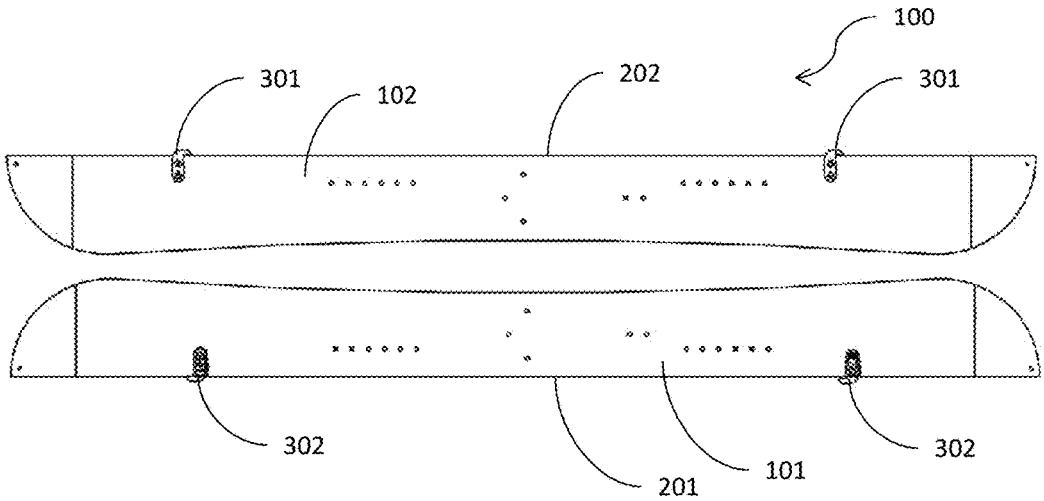
FIG. 2 is a top view of a splitboard in the split ski configuration.

With reference to the drawings, FIGS. 1 and 2 show a splitboard 100. FIG. 1 illustrates a top view of the splitboard 100 with a first ski 101 and a second ski 102 joined in the snowboard configuration. Joined splitboard 100 has a seam 103 created by inside edge 201 (see FIG. 2) of first ski 101 and inside edge 202 (see FIG. 2) of second ski 102 touching. An important element in creating a splitboard that performs well in ride mode is creating continuity between first ski 101 and second ski 102. Compressing inside edges 201 and 202 together at the seam 103 creates torsional stiffness in splitboard 100. Splitboard 100 is joined by splitboard joining device 300 which comprises a first attachment 302 and a second attachment 301.

FIG. 2 illustrates a top view of the splitboard 100 with a first ski 101 and a second ski 102 in the split ski configuration. In the split ski configuration the user can apply traction devices to the skis 101 and 102 to climb up snowy hills. First attachment 302 disengages from second attachment 301 allowing the skis 101 and 102 to be separated.

Figure 3A:
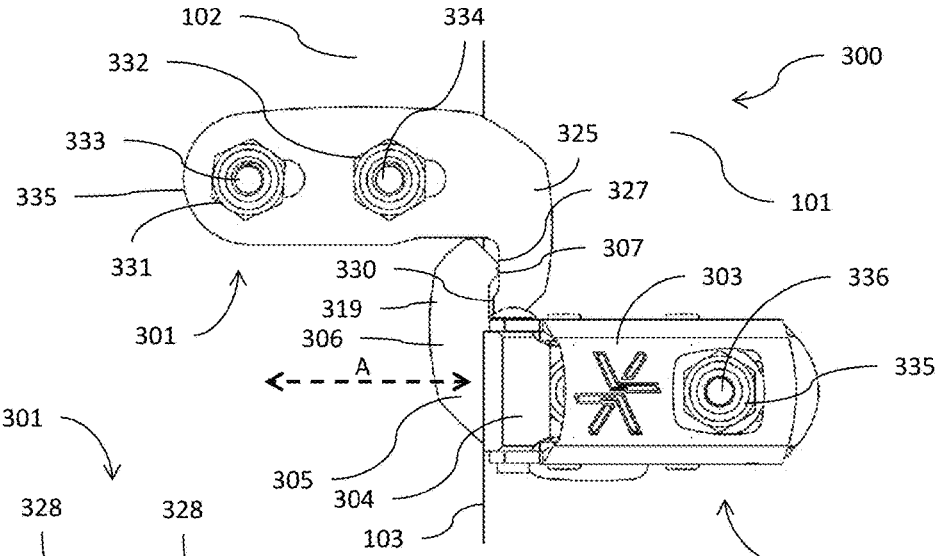
FIG. 3A is a top view of an example splitboard joining device in a first configuration.
Figure 3B:
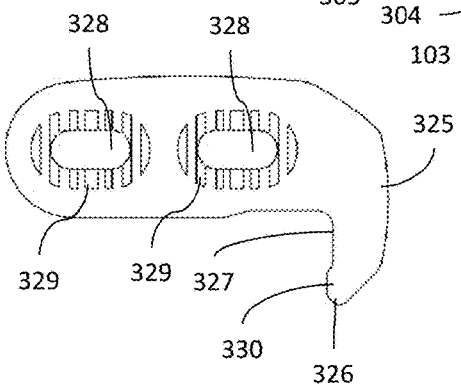
FIG. 3B is a top view of an example second attachment of a splitboard joining device.
Figure 3D:
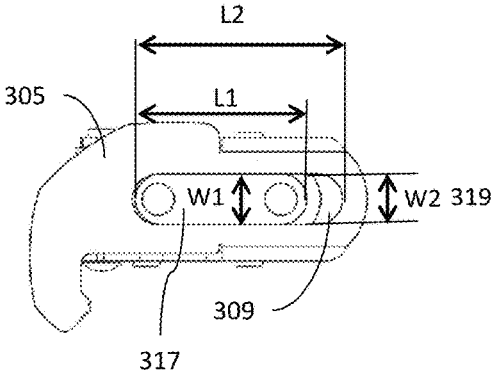
FIG. 3D is a bottom view of an example first attachment of a splitboard joining device.
Figure 3C:
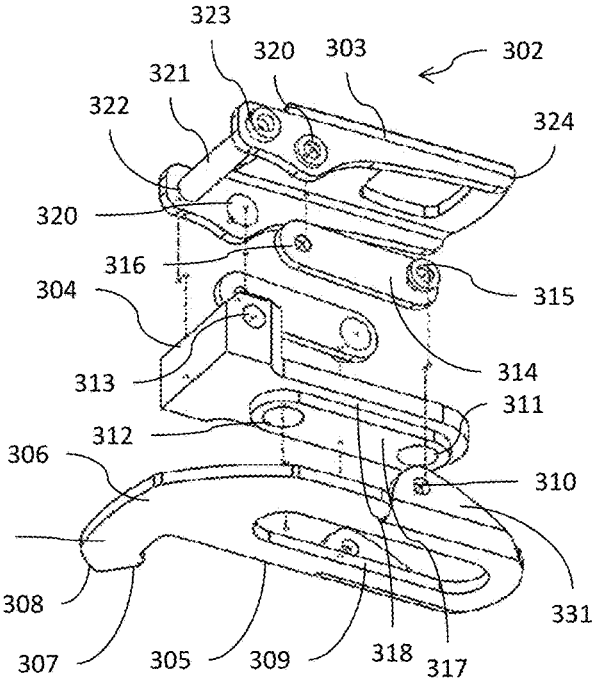
FIG. 3C is an exploded view of an example first attachment of a splitboard joining device.

FIGS. 3A-3D show detail views of embodiments of the splitboard joining device 300. FIG. 3A shows a top view of splitboard joining device 300 which can comprise a first attachment 302 and a second attachment 301. FIG. 3A further shows a top view of splitboard joining device 300 in a first configuration where the first attachment 302 and the second attachment 301 are joined creating tension between the first attachment 302 and the second attachment 301 and compression between the first ski 101 and the second ski 102. FIG. 3B shows a detailed top view of the second attachment 301. FIG. 3C shows an exploded view of the first attachment 302. FIG. 3D shows a bottom view of the first attachment 302.

First attachment 302 can further comprise translational base portion 305, fixed base portion 304, lever 303, and links 314. Translational base portion 305 can further comprise shear tab 306, shear tab hook 319, slot 309, tip 308, friction teeth 307, drive flange 331, and link pivot 310. Fixed base portion 304 can further comprise lever pivot 313, mounting holes 311 and 312, slot stand-off 317, and retaining surface 318. Links 314 can have pivots 316 and 315. Lever 303 can have pivots 322 and 323 which can rotate on rivet 321, link pivots 320 and end 324. Slot stand-off 317 extends through slot 309. The thickness of slot stand-off 317 can be equal or slightly thicker than the thickness of translational base portion 305 to allow fixed base portion 304 to be tightened down to the top surface 104 of first ski 101 with fastener 336 through mounting holes 311 and 312. Fastener 336 can be a screw, bolt, rivet, or other suitable fastening device. Fastener 336 can also have nut 335 to attach fixed base portion 304 and first ski 101.

In some embodiments, retaining surface 318 of fixed base portion 304 extends over the top of translational base portion 305 vertically constraining translational base portion 305. The closer the thickness of slot stand-off 317 to the thickness of translational base portion 305 the tighter the vertical constraint on translational base portion 305. Retaining surface 318 of fixed base portion 304 can constrain translational base portion 305 in a direction perpendicular to retaining surface 318, rotationally about the seam 103, and rotationally perpendicular to the seam 103.

The width W1 of slot stand-off 317 can be equal to or slightly narrower than width W2 of slot 309. The interaction between width W1 of slot stand-off 317 and width W2 of slot 309 can constrain translational base portion 305 in a direction generally parallel to the seam 103 of the splitboard, the closer the width W1 to width W2 the tighter the constraint. The interaction between width W1 of slot stand-off 317 and width W2 of slot 309 can also constrain translational base portion 305 rotationally generally in the plane of retaining surface 318, the closer the width W1 to width W2 the tighter the constraint. In some embodiments, length L1 of slot stand-off 317 is less than length L2 of slot 309 to allow translational base portion 305 to move in a direction generally perpendicular to seam 103 as shown by dashed line A in FIG. 3A.

Lever 303 can be attached though pivot holes 322 and 323 to fixed base portion 304 with fastener 321 through pivot hole 313. Fastener 321 can be a rivet, screw, bolt pin or other suitable fastener allowing rotation. Links 314 can attach to lever 303 through pivots 320 with a rivet, screw, pin or other suitable fastener. Links 314 can attach to link pivot 310 on drive flange 331 of translational base portion 305 with a rivet, screw, pin or similar fastener through pivot hole 315.

As show in FIG. 3B, second attachment 301 can comprise mounting slots 328, shear tab 325, hook 327, end 335, and tip 326. Mounting slots 328 can have friction surface 329 surrounding them to provide a grip surface for fastener to clamp to. Friction surface 329 can be triangular teeth, square teeth, round teeth, or any type of textured surface to increase friction.

Second attachment 301 can attach to second ski 102 with fasteners 333 and 334. Fasteners 333 and 334 can be screws, rivets, or other suitable fastening mechanisms. Nuts 331 and 332 can further be used to attach second attachment 301 to second ski 102. Upon mounting, second attachment 301 can be adjusted with mounting slots 328 relative to second ski 102. To increase tension in the first configuration, end 335 can be moved away from seam 103. To decrease tension in the first configuration, end 335 can be moved towards seam 103.

Figure 4A:
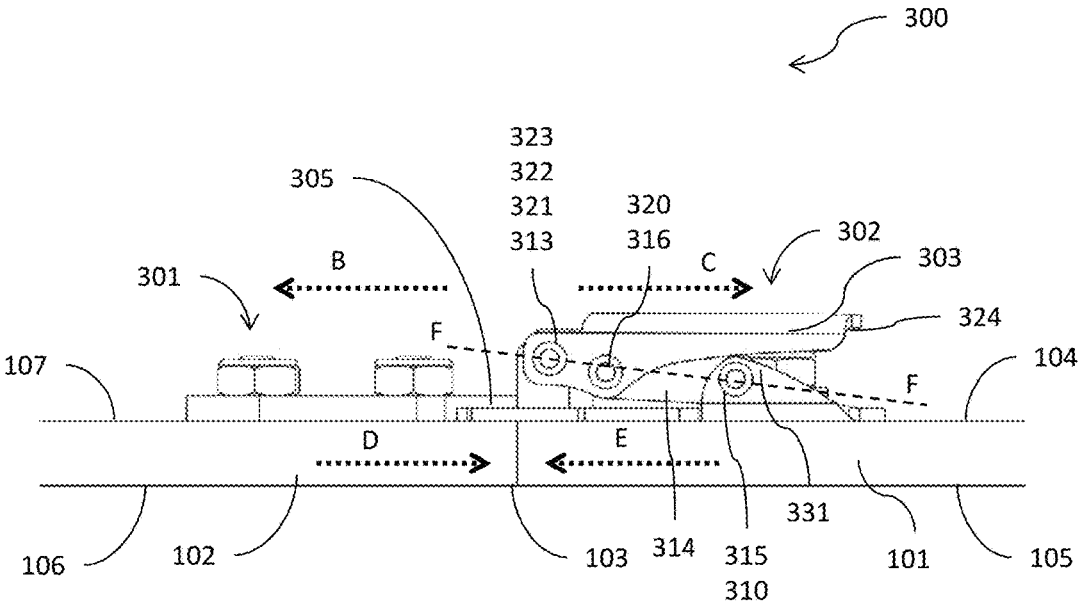
FIG. 4A is a side view of an example splitboard joining device in a first configuration.

FIG. 4A shows a side view of embodiments of the splitboard joining device 300 in a first configuration. The first attachment 302 and the second attachment 301 are joined thereby creating tension between the first attachment 302 along path C and the second attachment 301 along path B, and compression between the first ski 101 along path E and the second ski 102 along path D at seam 103.

Figure 4B:
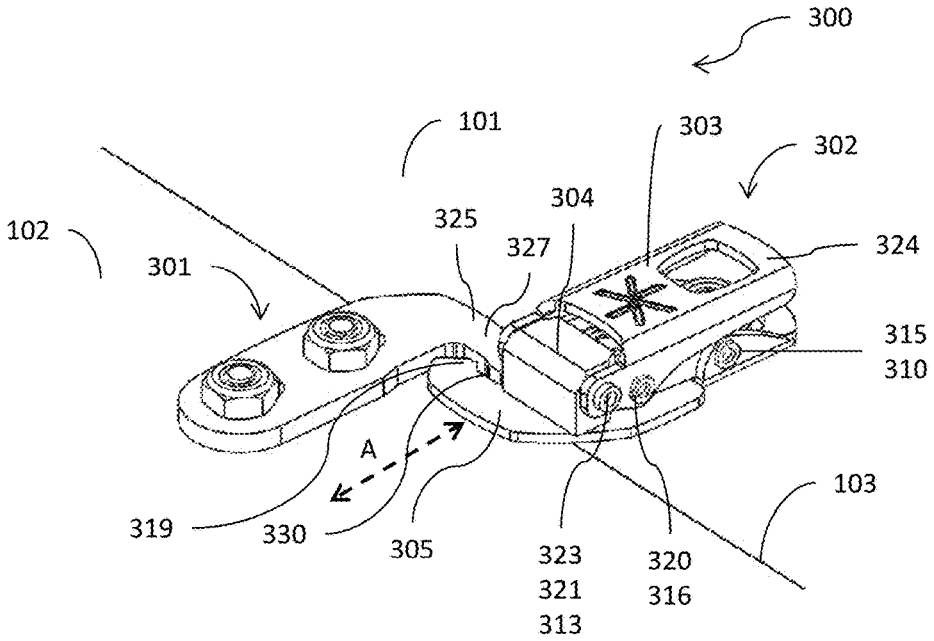
FIG. 4B is an isometric view of an example splitboard joining device in a first configuration.

FIG. 4B shows an isometric view of embodiments of the splitboard joining device 300 in the first configuration. Lever 303 is in a locked position with end 324 resting on drive flange 331. Link 314 pushes translational base portion 305 along path A (see FIG. 3A or 4B) with drive flange 331 moving away from seam 103 creating tension between first attachment 302 and second attachment 301 when shear tab hook 319 engages hook 327. Link pivot 320 of lever 303 rests below the over-center line of action F between pivot holes 322, 321 and 313 and link pivot 310 and pivot hole 315. Link pivot 320 resting below over-center line of action F is in an over-center position such that as tension is increased on shear tab hook 319 the pivot 320 wants to drop further below over-center line of action F meaning lever 303 will close further. The over-center position prevents lever 303 from opening without a significant upward force being applied to end 324. The resistance created in the over-center position is driven by the tension created between shear tab hook 319 of first attachment 302 and hook 327 of second attachment 301. The more interference between shear tab hook 319 and hook 327 in the first configuration the more tension is created. Interference between shear tab hook 319 and hook 327 can be increased or decreased as described in FIG. 3B.

Figure 5A:
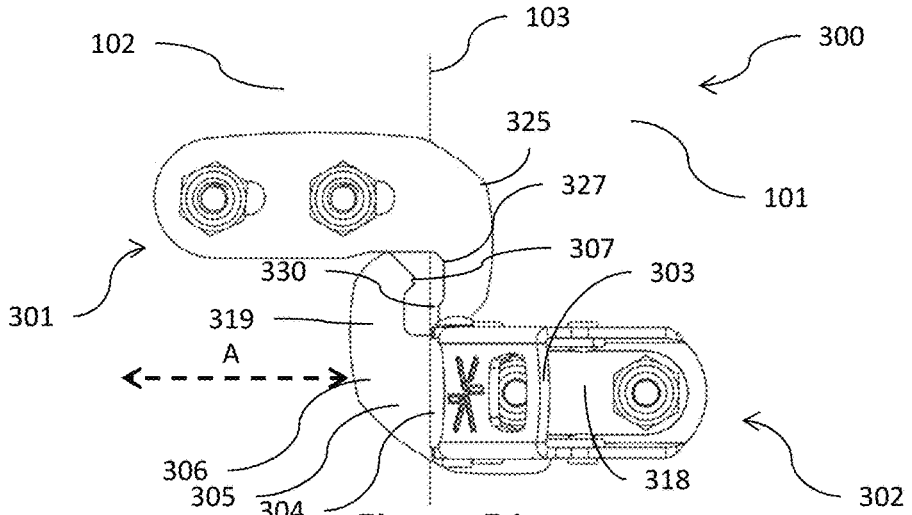
FIG. 5A is a top view of an example splitboard joining device in a second configuration.
Figure 5B:
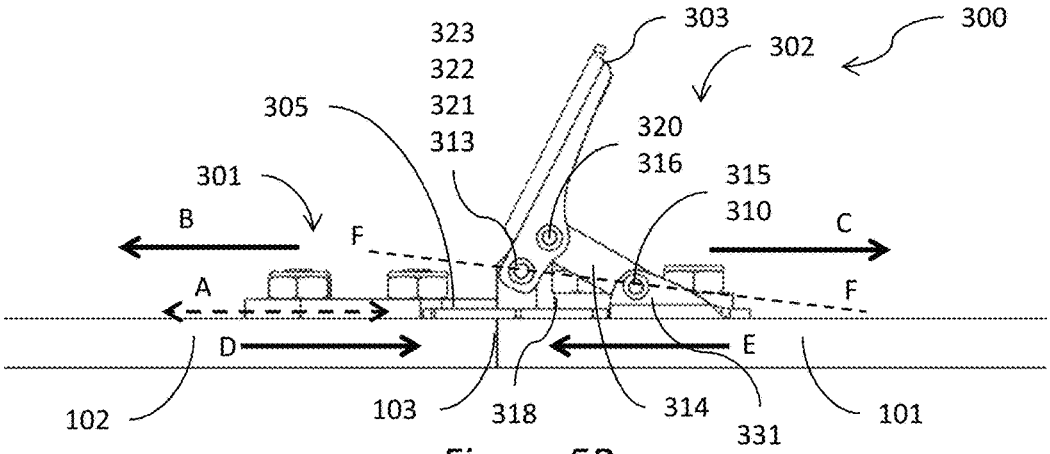
FIG. 5B is a side view of an example splitboard joining device in a second configuration.
Figure 5C:
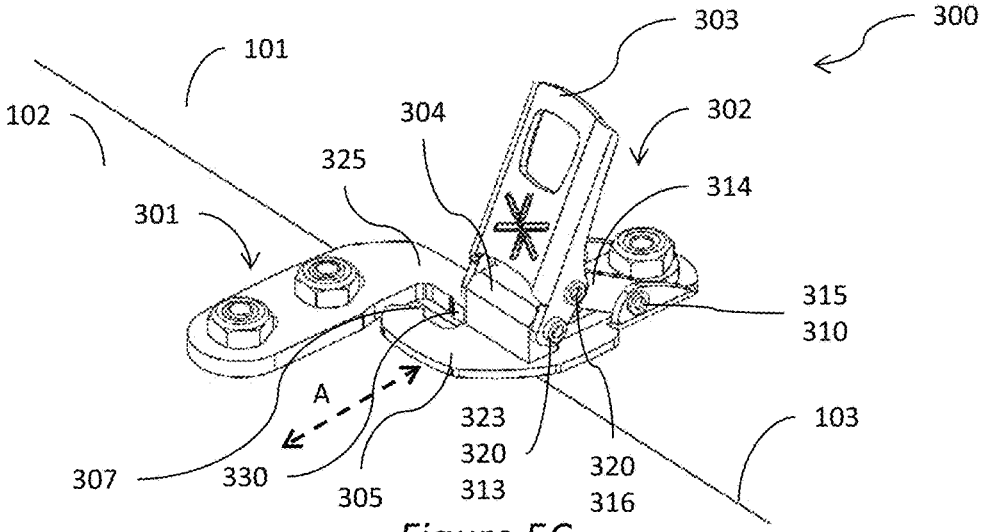
FIG. 5C is an isometric view of an example splitboard joining device in a second configuration.

FIG. 5A shows a top view of embodiments of the splitboard joining device 300 in a second configuration where the first attachment 302 and the second attachment 301 are disengaged in a direction generally perpendicular to the seam 103 of the splitboard 100 allowing the first ski 101 and second ski 102 to be quickly and easily separated into the split ski configuration shown in FIG. 2. FIG. 5B shows a side view of splitboard joining device 300 in the second configuration. FIG. 5C is an isometric view of splitboard joining device 300 in the second configuration.

With reference to FIGS. 5A-5C, in some embodiments, lever 303 is configured to be lifted up thereby releasing the tension between the first attachment 302 and the second attachment 301. Shear tab hook 319 moves away from seam 103 and hook 327 along path A perpendicular to seam 103 allowing first ski 101 and second ski 102 to be separated into the split ski configuration shown in FIG. 2. In some embodiments, to lift lever 303 from the first configuration shown in FIGS. 3A through 4B to the second configuration it takes a reasonable amount of force to pull the link pivot 316 and 320 of lever 303 past the over-center line of action F. Retaining surface 318 of fixed base portion 304 provides vertical constraint to translational base portion 305 such that when lever 303 is lifted and link 314 pulls on drive flange 331 of translational base portion 305 the upward force of lever 303 is translated into a horizontal motion along path A. Lever 303 rotates about pivots 322 and 323 with fastener 321 attaching lever 303 to fixed base portion 304 through pivot hole 313. As lever 303 rotates upward link 314 is pulled through link pivot 320 and pivots about pivot 316. The opposing end of link 314 pivot hole 315 pulls and pivots on link pivot 310 of drive flange 331 of translational base portion 305.

Figure 6A:
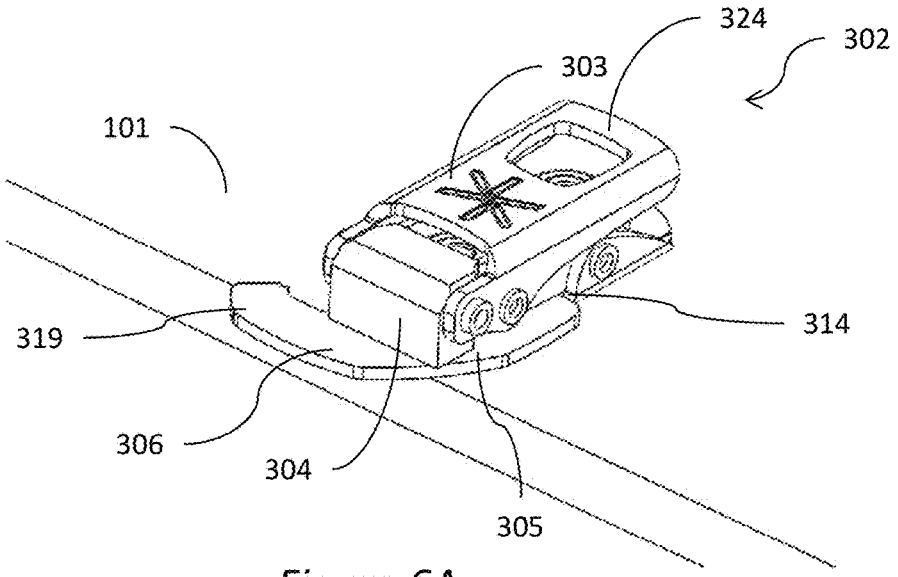
FIG. 6A is an isometric view of an example first attachment of a splitboard joining device in a third configuration.

FIG. 6A is an isometric view of first attachment 302 in a third configuration where first attachment 302 and second attachment 301 are not engaged and first ski 101 is in the split ski configuration shown in FIG. 2. Lever 303 is closed in the over-center position as shown in FIG. 4A. The over-center position prevents lever 303 from opening without a significant upward force being applied to end 324. The resistance created in the over-center position is driven by the compression created between translational base portion 305 and fixed base portion 304, which is further described in FIGS. 7A and 7B. The over-center position in the third configuration keeps the first attachment 302 from rattling when first ski 101 moves.

Figure 6B:
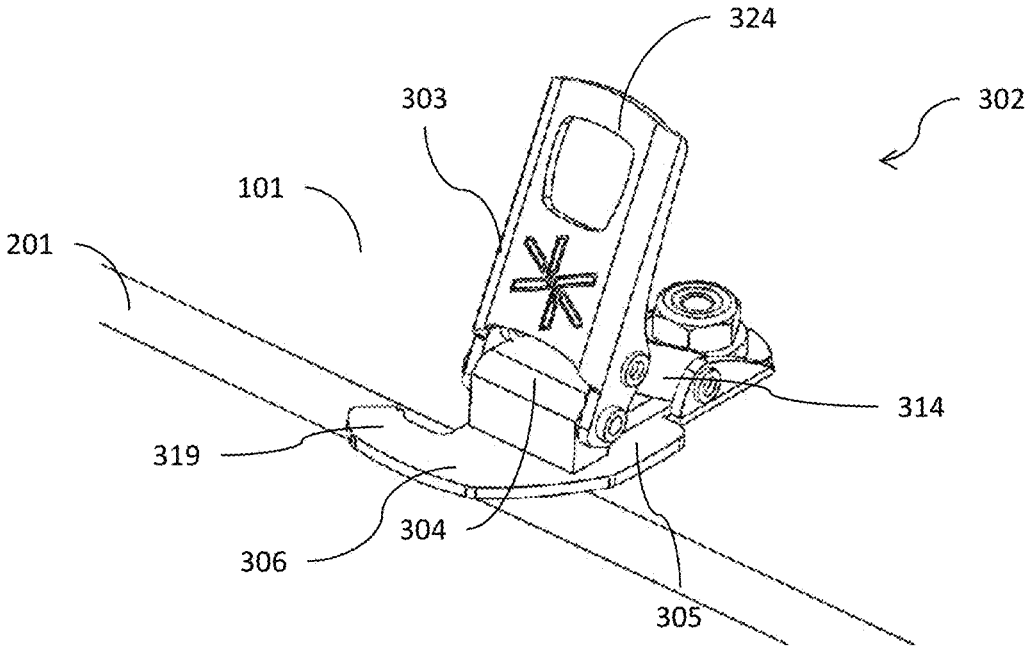
FIG. 6B is an isometric view of an example first attachment of a splitboard joining device in a fourth configuration.

FIG. 6B is an isometric view of first attachment 302 in a fourth configuration where first attachment 302 and second attachment 301 are not engaged. First ski 101 can be in the split ski configuration shown in FIG. 2. Lever 303 is open driving shear tab hook 319 of translational base portion 305 away from inside edge 201. In the fourth configuration, first attachment 302 is ready to engage second attachment 301 as shown in FIGS. 5A through 5C.

Figure 7A:
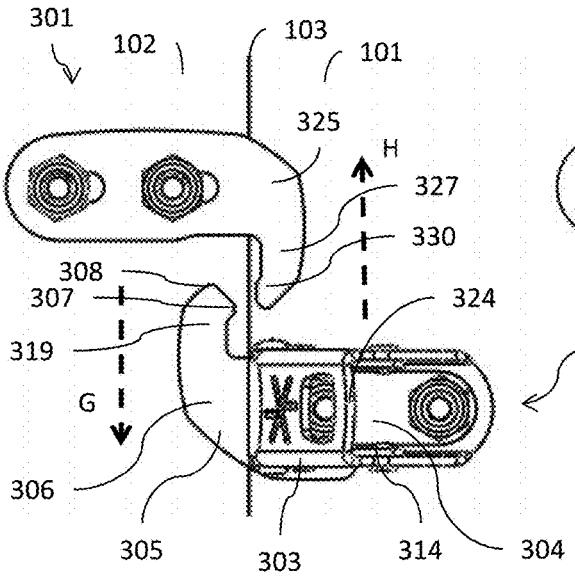
FIG. 7A is a top view of an example splitboard joining device in a fourth configuration.

FIG. 7A shows the first attachment 302 in the fourth configuration shown in FIG. 6B where lever 303 is open, thereby driving shear tab hook 319 of translational base portion 305 away from inside edge 201. In the fourth configuration as shown, first attachment 302 is ready to engage second attachment 302, and first ski 101 and second ski 102 can touch creating seam 103. Second attachment 301 and second ski 102 can move along path G and first attachment 302 and first ski 101 can move along path H to allow first attachment 302 and second attachment 301 to engage. First attachment 302 can be engaged with second attachment 301 when tip 308 touches second attachment 301 and tip 326 touches first attachment 302.

Figure 7B:
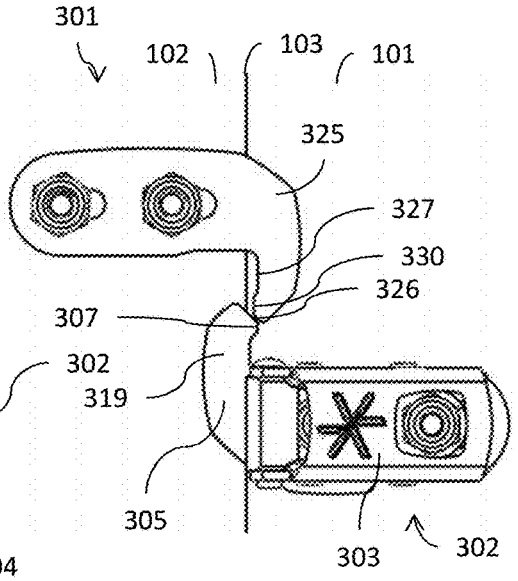
FIG. 7B is a top view of an example splitboard joining device in a third configuration.

FIG. 7B shows the first attachment 302 in the third configuration shown in FIG. 6A where lever 303 is closed such that shear tab hook 319 of translational base portion 305 is pulled closer or crossing seam 103. First attachment 302 and second attachment 301 cannot fully engage as friction teeth 307 cannot pass tip 326.

Figure 7C:
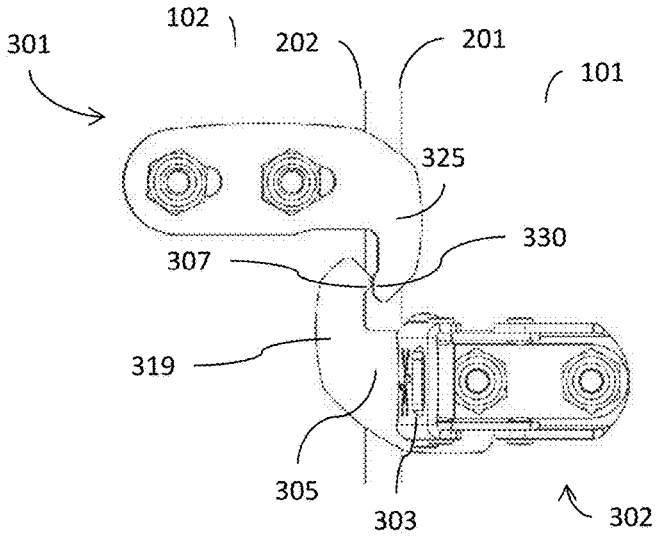
FIG. 7C is another top view of an example splitboard joining device in a fourth configuration.

FIG. 7C shows embodiments of the splitboard joining device where the first attachment 302 and the second attachment 301 can be engaged without inside end 201 of first ski 101 and inside edge 202 of second ski 102 touching. First attachment 302 is in the fourth configuration described in FIG. 6B.

Figure 8A:
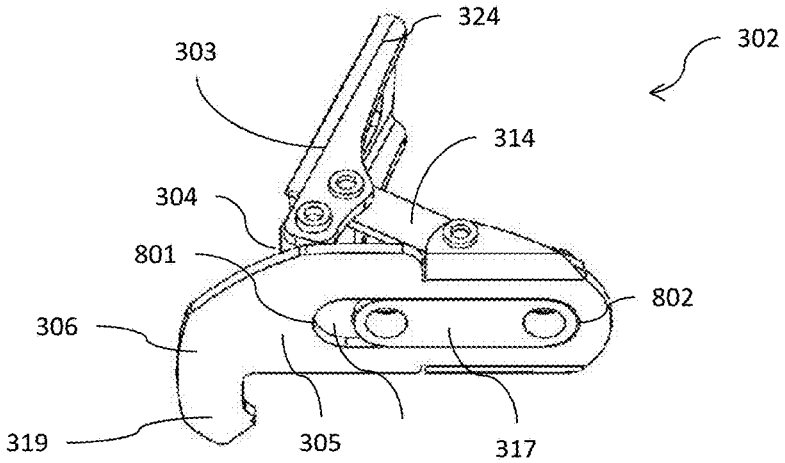
FIG. 8A is a profile view of the bottom of an example first attachment of a splitboard joining device.
Figure 8B:
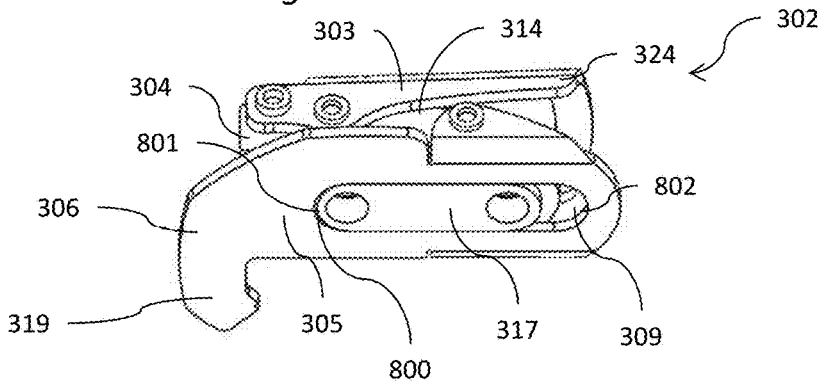
FIG. 8B is another profile view of the bottom of an example first attachment of a splitboard joining device.

FIGS. 8A and 8B are bottom angled views of embodiments of first attachment 302 showing the translation of translational base portion 305 relative to fixed base portion 304 of first attachment 302. FIG. 8A shows first attachment 302 in either the second configuration described in FIGS. 5A through 5C or fourth configuration described in FIG. 6B with lever 303 open. Slot 309 can have locked end 801 and open end 802. In the second configuration or fourth configuration, open end 802 of slot 309 can touch slot stand-off 317.

FIG. 8B shows the first attachment 302 in either the first configuration described in FIGS. 3A through 4B or the third configuration shown in FIG. 6A with lever 303 closed. In some embodiments of the first configuration or the third configuration, locked end 801 can touch or interfere with slot stand-off 309 creating the resistance in the over-center position described in FIG. 6A.

Figure 9A:
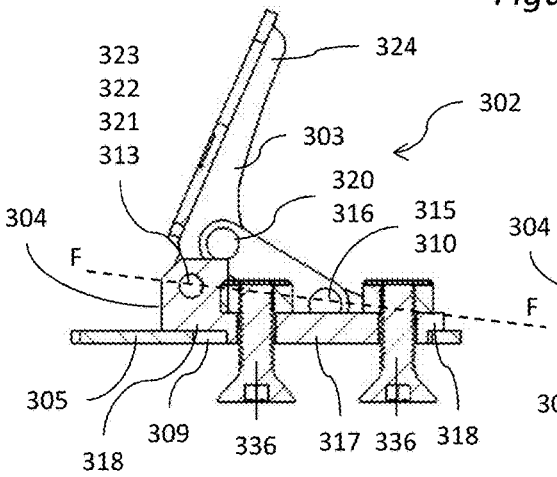
FIG. 9A is a side cross-sectional view on an example first attachment of a splitboard joining device.
Figure 9B:
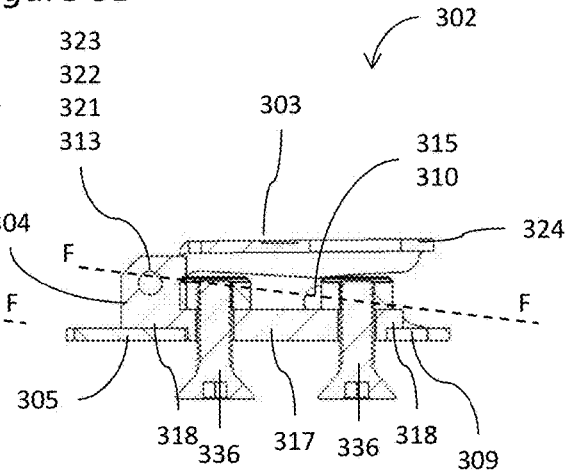
FIG. 9B is another side cross-sectional view on an example first attachment of a splitboard joining device.

FIGS. 9A and 9B show cross-sectional views of first attachment 302 where hatched features are cross-sections. Both figures show translational base portion 305 constrained vertically by restraining surface 318 of fixed base portion 304. The features of FIG. 9A are further described above with reference FIG. 5B. The features of FIG. 9B are further described above with reference FIG. 4A.

The splitboard joining device and components thereof disclosed herein and described in more detail above may be manufactured using any of a variety of materials and combinations. In some embodiments, a manufacturer may use one or more metals, such as Aluminum, Stainless Steel, Steel, Brass, alloys thereof, other suitable metals, and/or combinations thereof to manufacture one or more of the components of the splitboard binding apparatus of the present disclosure. In some embodiments, the manufacturer may use one or more plastics to manufacture one or more components of the splitboard joining device of the present disclosure. In some embodiments, the manufacturer may use carbon-reinforced materials, such as carbon-reinforced plastics, to manufacture one or more components of the splitboard binding apparatus of the present disclosure. In some embodiments, the manufacturer may manufacture different components using different materials to achieve desired material characteristics for the different components and the splitboard joining device as a whole.

Conditional language such as, among others, "can," "could," "might," or "may," unless specifically stated otherwise, are otherwise understood within the context as used in general to convey that certain embodiments include, while other embodiments do not include, certain features, elements, and/or steps. Thus, such conditional language is not generally intended to imply that features, elements, and/or steps are in any way required for one or more embodiments.

Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

It should be emphasized that many variations and modifications may be made to the embodiments disclosed herein, the elements of which are to be understood as being among other acceptable examples. Accordingly, it should be understood that various features and aspects of the disclosed embodiments can be combined with or substituted for one another in order to form varying modes of the disclosed apparatus, systems, and methods. All such modifications and variations are intended to be included and fall within the scope of the embodiments disclosed herein. The present disclosure may be embodied in other specific forms without departing from its spirit or essential characteristics. The described embodiments are to be considered in all respects only as illustrative and not restrictive.

What is claimed is:

1. A splitboard joining device comprising:

a first attachment configured to attach to a first ski of a splitboard;

a second attachment configured to attach to a second ski of a splitboard;

wherein the first attachment and the second attachment comprise a first configuration where the first attachment and the second attachment are joined, thereby creating tension between the first attachment and the second attachment and compression between the first ski and the second ski;

wherein the first attachment and the second attachment comprise a second configuration where the first attachment and the second attachment are disengaged, thereby reducing tension between the first attachment and the second attachment, and reducing compression between the first ski and second ski;

wherein the first attachment and the second attachment comprise a third configuration where the first attachment and the second attachment are fully disengaged such that the first ski and the second ski can be separated for use in tour mode;

wherein the first attachment and the second attachment can only move to the third configuration from the second configuration, and wherein to move from the second configuration to the third configuration the first attachment is configured to move away from the second attachment in a direction generally parallel to the seam of the splitboard and in a direction generally in plane with the top of the first ski and the top of the second ski;

wherein the first attachment comprises a tensioning element movable in a plane generally parallel to the top of the first ski and second ski, and wherein the second attachment comprises a receiving element configured to engage the tensioning element of the first attachment wherein the receiving element is also configured to extend generally perpendicular to a tensioning direction and offset from a mounting position of the second attachment of the second ski;

wherein the tensioning element is movable between a first position and a second position, and wherein the first attachment and the second attachment are configured such that when the tensioning element is in the first position and engaged with the receiving element of the second attachment, the first attachment and second attachment are in the first configuration;

wherein the first attachment and the second attachment are configured such that when the tensioning element is in the second position and has reduced engagement with the receiving element of the second attachment, the first attachment and second attachment are in the second configuration;

wherein the splitboard joining device further comprises an adjustable tension element configured to adjustably control the tension between the first attachment and the second attachment and configured to adjustably control the compression between the first and second skis when coupled, when the first attachment and second attachment are in the first configuration.

2. The splitboard joining device of claim 1, wherein the first attachment and the second attachment can only move to the second configuration from the third configuration, and wherein to move from the third configuration to the second configuration the first attachment is configured to move toward the second attachment in a direction generally parallel to the seam of the splitboard and in a direction generally in plane with the top of the first ski and the top of the second ski.

3. The splitboard joining device of claim 1, wherein the first attachment and the second attachment can only move to the first configuration from the second configuration.

4. The splitboard joining device of claim 1, wherein the tensioning element is only moveable in a plane parallel to the top of the first ski and the second ski.

5. The splitboard joining device of claim 1, wherein a mounting position of the first attachment to the first ski and the mounting position of the second attachment to the second ski are offset in a direction parallel with the seam of the splitboard, and wherein the tensioning element of the first attachment and the receiving element of the second attachment are configured to engage at a location between the offset mounting positions.

6. The splitboard joining device of claim 1, wherein the second attachment is generally L shaped and comprises a first leg and a second leg such that the second leg is oriented approximately 90 degrees relative to the first leg, wherein the mounting position is on the first leg of the second attachment and the receiving element is on the second leg of the second attachment.

7. The splitboard joining device of claim 6, wherein the mounting position of second attachment comprises the adjustable tension element, and wherein the adjustable tension element comprises at least one slotted mounting hole on the first leg such that to increase tension the receiving element can move in a direction generally perpendicular from a seam of a splitboard toward the second attachment's mounting position, wherein the adjustable tension element is configured such that to decrease tension the receiving element can move in a direction from the second attachment's mounting position and generally perpendicular toward a seam of a splitboard, and wherein the receiving element is configured to be fixed in place at a desired tension between the first attachment and the second attachment.

8. The splitboard joining device of claim 1, wherein in the first configuration and the second configuration the first attachment is configured to touch the second attachment to position the first ski relative to the second ski in a direction parallel to the seam of a splitboard.

9. The splitboard joining device of claim 1, wherein the tensioning element of the first attachment is configured to be driven by a lever rotating about a pivot.

10. The splitboard joining device of claim 1, wherein the first attachment comprises a member configured to extend across the seam of a splitboard to prevent upward movement of a first ski relative to a second ski.

11. The splitboard joining device of claim 1, wherein the first attachment comprises a first member configured to extend across the seam of a splitboard to prevent upward movement of a first ski relative to a second ski, and wherein the second attachment comprises a second member configured to extend across the seam of a splitboard to prevent upward movement of a first ski relative to a second ski.

12. The splitboard joining device of claim 1, wherein the first attachment is configured to not be removed from the first ski during normal operation and the second attachment is configured to not be removed from the second ski during normal operation.

13. A splitboard joining device comprising:

a first attachment configured to attach to a first ski of a splitboard and not be removed from the first ski during normal operation;

a second attachment configured to attach to a second ski of a splitboard and not be removed from the second ski during normal operation;

wherein the first attachment and the second attachment comprise a first configuration where the first attachment and the second attachment are joined, thereby creating tension between the first attachment and the second attachment and compression between the first ski and the second ski;

wherein the first attachment and the second attachment comprise a second configuration where the first attachment and the second attachment are disengaged, thereby reducing tension between the first attachment and the second attachment, and reducing compression between the first ski and second ski;

wherein the first attachment and the second attachment comprise a third configuration where the first attachment and the second attachment are fully disengaged such that the first ski and the second ski can be separated for use in tour mode;

wherein the first attachment and the second attachment can only move to the third configuration from the second configuration, and wherein to move from the second configuration to the third configuration the first attachment is configured to move away from the second attachment in a direction generally parallel to the seam of the splitboard and in a direction generally in plane with the top of the first ski and the top of the second ski;

wherein the first attachment comprises a member configured to extend across the seam of the splitboard to prevent upward movement of the second ski relative to the first ski;

wherein the first attachment further comprises a tensioning element, and wherein the second attachment comprises a generally L shape with a first leg and a second leg such that the second leg is oriented approximately 90 degrees relative to the first leg, wherein the first leg comprises at least one mounting position and the second leg comprises a receiving element, the receiving element configured to engage the tensioning element of the first attachment;

wherein the tensioning element is movable between a first position and a second position, and wherein the first attachment and the second attachment are configured such that when the tensioning element is in the first position and engaged with the receiving element of the second attachment, the first attachment and second attachment are in the first configuration;

wherein the first attachment and the second attachment are configured such that when the tensioning element is in the second position and has reduced engagement with the receiving element of the second attachment, the first attachment and second attachment are in the second configuration;

wherein the at least one mounting position of the first leg of the second attachment comprises an adjustable tension element configured to adjustably control the tension between the first attachment and the second attachment and configured to adjustably control the compression between first and second skis when coupled, when the first attachment and second attachment are in the first configuration;

wherein the adjustable tension element comprises at least one slotted mounting hole such that to increase tension the receiving element is configured to move in a direction generally perpendicular from a seam of a splitboard toward the second attachment's mounting position, and wherein the adjustable tension element is configured such that to decrease tension the receiving element is configured to move in a direction from the second attachment's mounting position and generally perpendicular toward a seam of a splitboard, and wherein the receiving element is configured to be fixed in place at a desired tension between the first attachment and the second attachment.

14. The splitboard joining device of claim 13, wherein the mounting position of the first attachment to the first ski and the mounting position of the second attachment to the second ski are offset in a direction parallel with a seam of a splitboard, and wherein the tension element of the first attachment and the receiving element of the second attachment are configured to engage at a location between the offset mounting positions.

15. The splitboard joining device of claim 13, wherein in the first configuration and the second configuration the first attachment is configured to touch the second attachment to position the first ski relative to the second ski in a direction parallel to the seam of a splitboard.

16. The splitboard joining device of claim 13, wherein the second attachment comprises a member configured to extend across the seam of a splitboard to prevent upward movement of a first ski relative to a second ski.

17. A splitboard joining device comprising:

a first attachment configured to attach to a first ski of a splitboard;

a second attachment configured to attach to a second ski of a splitboard;

an adjustable tension element configured to adjustably control the tension between the first attachment and the second attachment and configured to adjustably control the compression between first and second skis when coupled;

wherein the first attachment and the second attachment comprise a first configuration where the first attachment and the second attachment are joined, thereby creating tension between the first attachment and the second attachment and compression between the first ski and the second ski;

wherein the first attachment and the second attachment comprise a second configuration where the first attachment and the second attachment are disengaged, thereby reducing tension between the first attachment and the second attachment, and reducing compression between the first ski and second ski;

wherein the first attachment and the second attachment comprise a third configuration where the first attachment and the second attachment are fully disengaged such that the first ski and the second ski can be separated for use in tour mode;

wherein the first attachment and the second attachment can only move to the third configuration from the second configuration, and wherein to move from the second configuration to the third configuration the first attachment is configured to move away from the second attachment in a direction generally parallel to the seam of the splitboard and in a direction generally in plane with the top of the first ski and the top of the second ski;

wherein the first attachment and the second attachment can only move to the second configuration from the third configuration, and wherein to move from the third configuration to the second configuration the first attachment is configured to move toward the second attachment in a direction generally parallel to the seam of the splitboard and in a direction generally in plane with the top of the first ski and the top of the second ski;

wherein the first attachment and the second attachment can only move to the first configuration from the second configuration.

18. The splitboard joining device of claim 17, wherein the first attachment comprises a tensioning element movable in a plane generally parallel to the top of the first ski and the second ski, and wherein the second attachment comprises a receiving element configured to engage and disengage the tensioning element of the first attachment;

wherein the tensioning element is movable between a first position and a second position, and wherein when the tensioning element is in the first position and engaged with the receiving element of the second attachment, the first attachment and the second attachment are in the first configuration;

wherein when the tensioning element is in the second position and has reduced engagement with the receiving element of the second attachment, the first attachment and the second attachment are in the second configuration.

19. The splitboard joining device of claim 18, wherein the tensioning element of the first attachment is configured to be driven by a lever rotating about a pivot.

20. The splitboard joining device of claim 17, wherein the second attachment comprises the adjustable tension element, wherein the adjustable tension element comprises at least one slotted mounting hole, wherein the adjustable tension element is configured such that to increase tension the receiving element is configured to move in a direction generally perpendicular from the seam of a splitboard toward the second attachment's mounting position, wherein the adjustable tension element is configured such that to decrease tension the receiving element is configured to move in a direction from the second attachment's mounting position and generally perpendicular toward the seam of a splitboard, and wherein the receiving element can be fixed in place at a desired tension between the first attachment and the second attachment.

21. The splitboard joining device of claim 17, wherein the first attachment is configured to not be removed from the first ski during normal operation and the second attachment is configured to not be removed from the second ski during normal operation.

22. The splitboard joining device of claim 17, wherein the first attachment comprises a member configured to extend across the seam of a splitboard to prevent upward movement of a first ski relative to a second ski.

23. The splitboard joining device of claim 22, wherein the second attachment comprises a member configured to extend across the seam of a splitboard to prevent upward movement of a first ski relative to a second ski.

* * * * *